US009649777B2

(12) United States Patent
Foley et al.

(10) Patent No.: US 9,649,777 B2
(45) Date of Patent: May 16, 2017

(54) KINETIC LOG SPLITTER

(71) Applicant: Blount, Inc., Portland, OR (US)

(72) Inventors: Patrick Foley, Golden, CO (US); Drew Arnold, Portland, OR (US); Don Leliefeld, Boring, OR (US); Emanuel Guzman, Golden, CO (US); Ron Bowman, Golden, CO (US)

(73) Assignee: BLOUNT, INC., Portland, OR (US)

( * ) Notice: Subject to any disclaimer, the term of this patent is extended or adjusted under 35 U.S.C. 154(b) by 237 days.

(21) Appl. No.: 14/555,449

(22) Filed: Nov. 26, 2014

(65) Prior Publication Data

US 2015/0151448 A1 Jun. 4, 2015

Related U.S. Application Data

(60) Provisional application No. 61/910,182, filed on Nov. 29, 2013.

(51) Int. Cl.
*B27L 7/00* (2006.01)

(52) U.S. Cl.
CPC ..... *B27L 7/00* (2013.01)

(58) Field of Classification Search
CPC ..... B27L 7/00; B27L 7/06; B27L 7/08
See application file for complete search history.

(56) References Cited

U.S. PATENT DOCUMENTS

| | | | | |
|---|---|---|---|---|
| 4,116,251 | A * | 9/1978 | Graney | B27L 7/00 144/193.1 |
| 4,176,698 | A * | 12/1979 | Ahlschlager | B27L 7/00 144/193.1 |
| 4,246,941 | A * | 1/1981 | Campbell | B27L 7/00 144/195.2 |
| 4,258,764 | A | 3/1981 | Gerst | |
| 4,354,537 | A | 10/1982 | Balkus | |
| 5,921,300 | A | 7/1999 | Smith | |
| 8,006,725 | B2 * | 8/2011 | Majkrzak | B27L 7/00 144/193.2 |
| 2008/0271817 | A1 | 11/2008 | Priebe | |
| 2013/0000785 | A1 | 1/2013 | Banjo | |

* cited by examiner

*Primary Examiner* — Matthew G Katcoff
(74) *Attorney, Agent, or Firm* — Schwabe Williamson & Wyatt, P.C.

(57) ABSTRACT

A log splitter where splitting force is generated by storing kinetic energy in a rotating flywheel. Rotational energy is converted to splitting force by means of a rack and pinion, which is coupled to the flywheels through a belt-driven clutch system. A belt rests around a driven sheave and a drive sheave. An idler pulley tensions the belt, causing the driven pulley to rotate. The idler pulley is attached to an actuation handle causing the idler to lock, by means of a latch, until the operator disengages the pulley, or until a component mounted to the rack forces the latch to disengage. The rack remains engaged to the pinion by a bearing mounting system. A spring bumper may be placed at the end of travel so that at the end of the stroke, the ram mechanism compresses the spring, and uses stored energy to reverse the ram, pinion and sheave.

21 Claims, 17 Drawing Sheets

KINETIC LOG SPLITTER

CROSS REFERENCE TO RELATED APPLICATIONS

The present application claims priority to U.S. Provisional Patent Application No. 61/910,182, filed Nov. 29, 2013, entitled "Kinetic Log Splitter with Belt Clutch," the entire disclosure of which is hereby incorporated by reference in its entirety.

TECHNICAL FIELD

Embodiments herein relate to the field of log splitters, and, more specifically, to a kinetic log splitter.

BACKGROUND

Utilizing kinetic energy stored in flywheels to split wood allows for efficient use of fuel and a productive use of an operator's time. Wood splitting devices typically function by driving a wedge into a log either by pushing the log onto the wedge, or by forcing a wedge into a log. Many conventional kinetic log splitters force a stationary rack onto a moving pinion which is hard on both the machine and the operator pushing down on the rack. Providing an effective means of decoupling the drive mechanism from the energy storing flywheels will reduce the shock load that is experienced by the operator, and reduce the amount of wear on the log splitter.

BRIEF DESCRIPTION OF THE DRAWINGS

Embodiments will be readily understood by the following detailed description in conjunction with the accompanying drawings and the appended claims. Embodiments are illustrated by way of example and not by way of limitation in the figures of the accompanying drawings.

DETAILED DESCRIPTION OF DISCLOSED EMBODIMENTS

Figure 1:
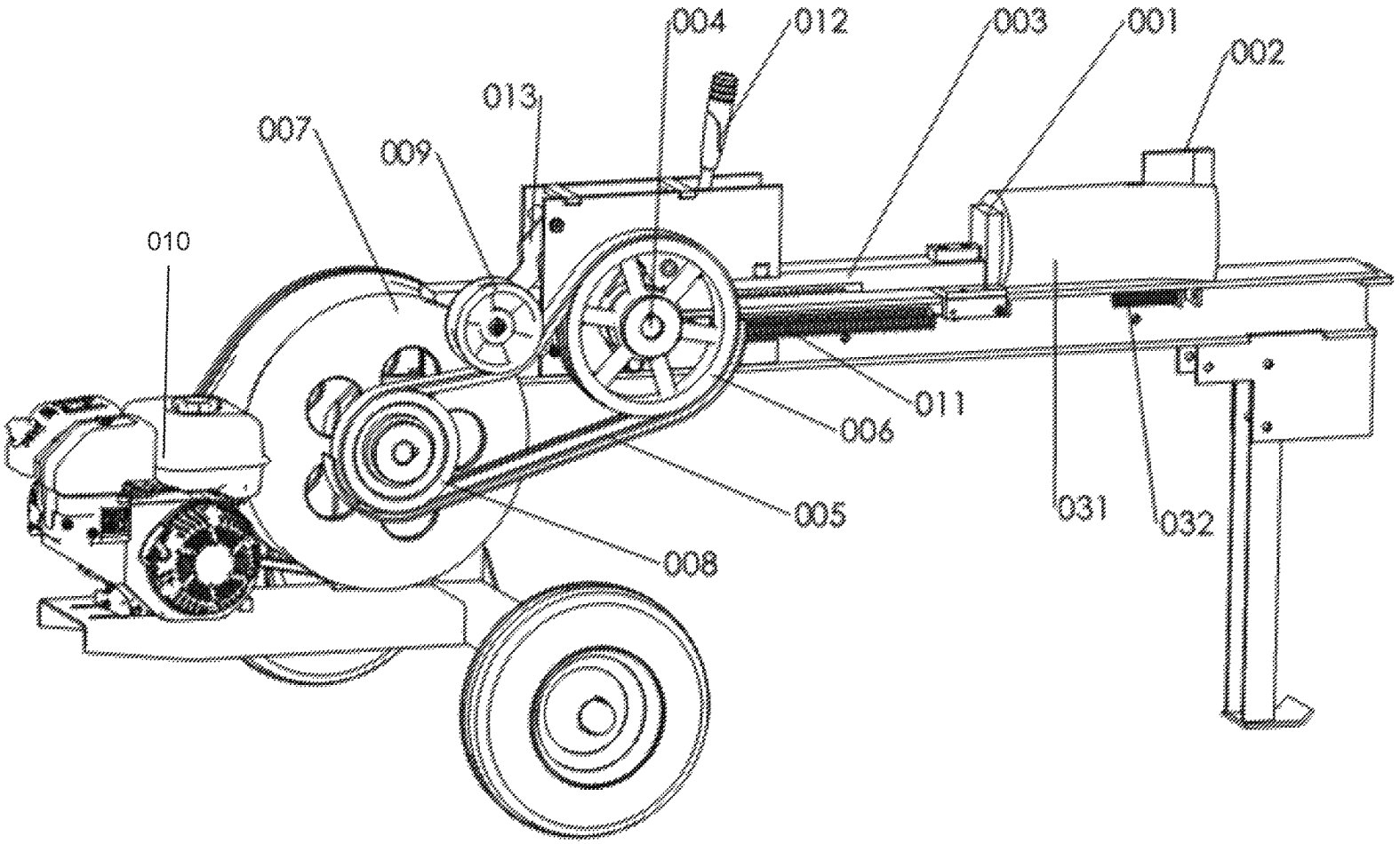
FIG. 1 illustrates a first side view of a kinetic splitter and components thereof, in accordance with various embodiments.
Figure 2:
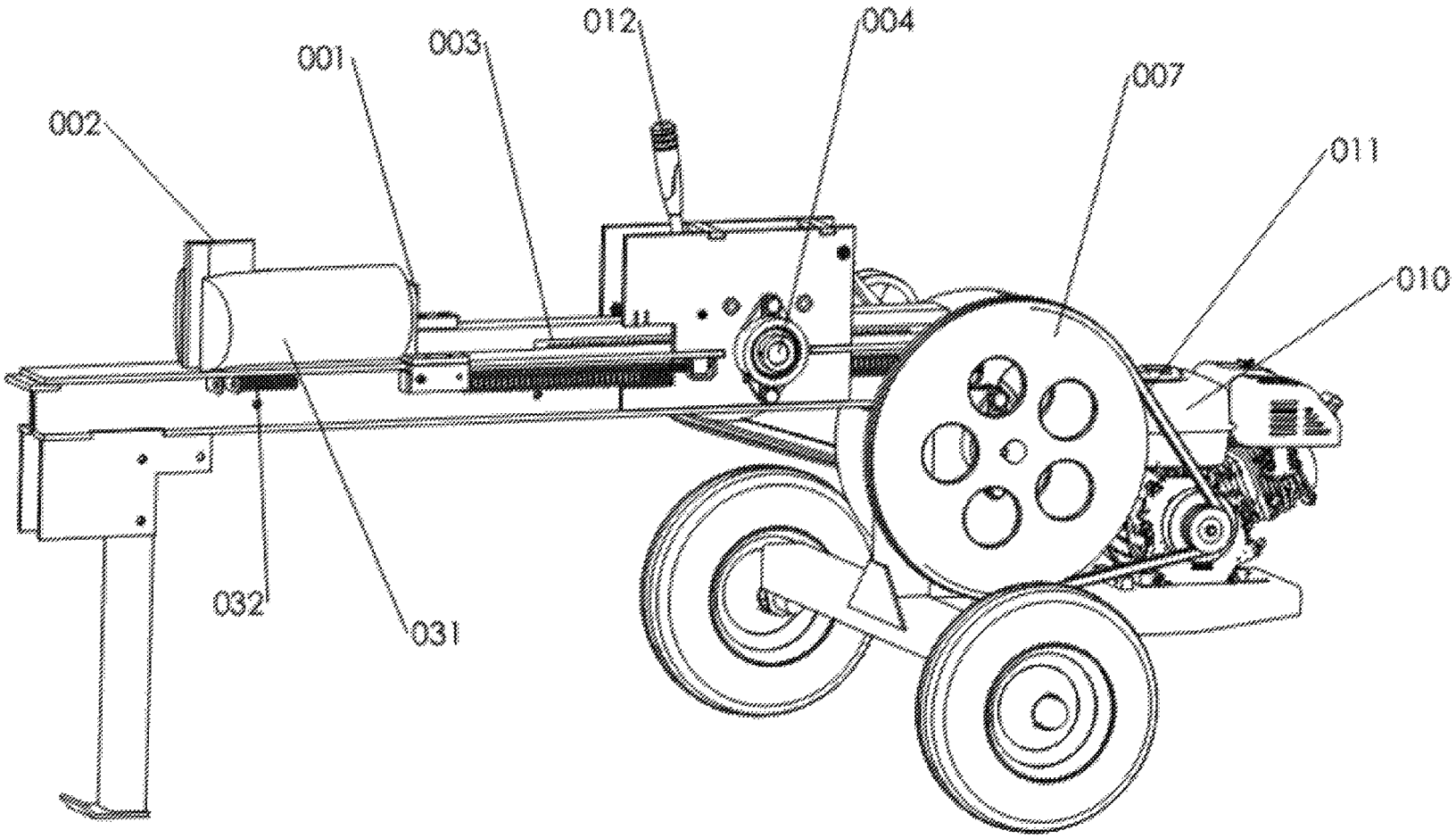
FIG. 2 illustrates an alternative side view of a kinetic splitter and components thereof, in accordance with various embodiments.
Figure 3A:
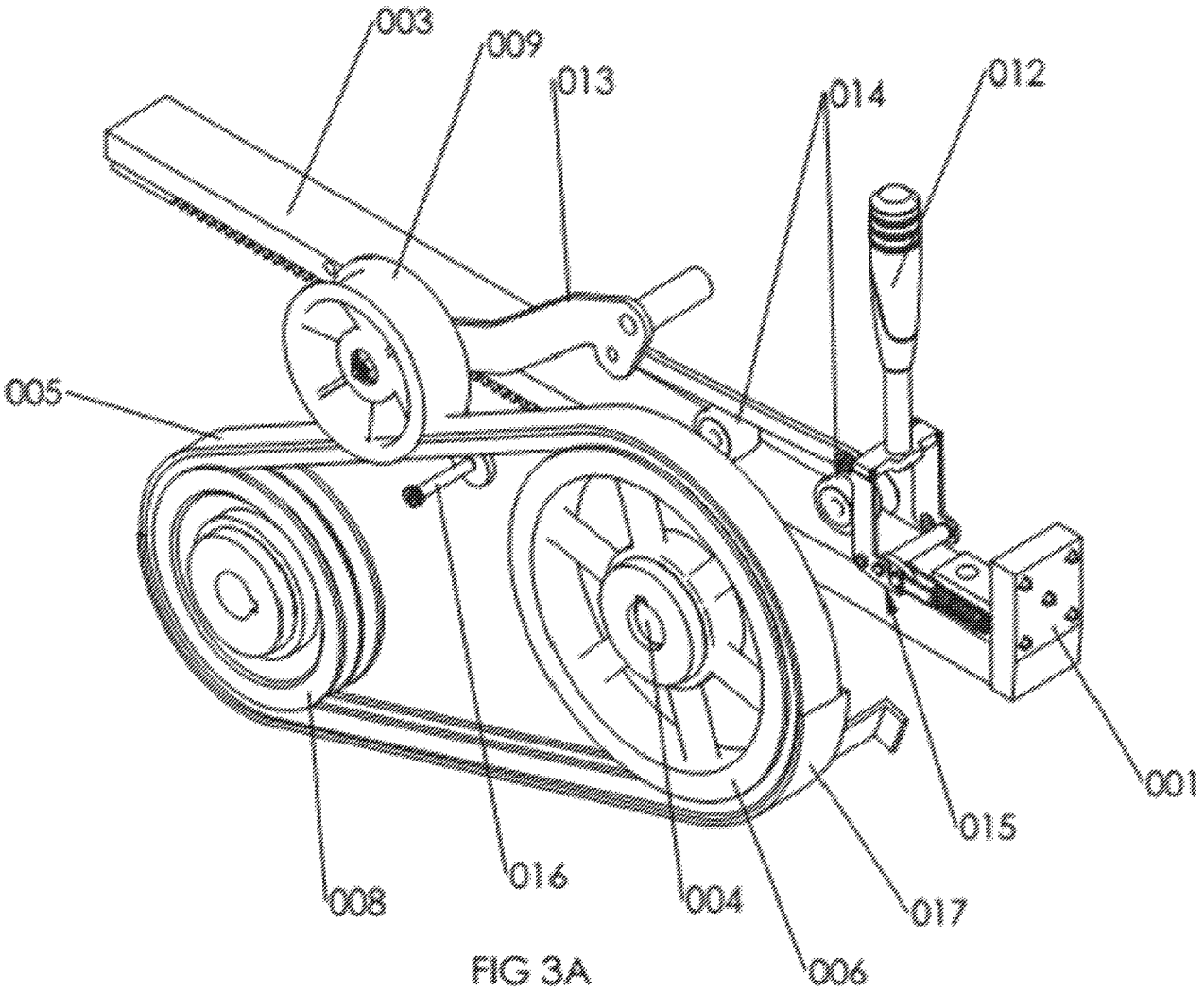
FIG. 3A illustrates a first side view of a belt drive system of a kinetic splitter and components thereof in a disengaged state, in accordance with various embodiments.
Figure 3B:
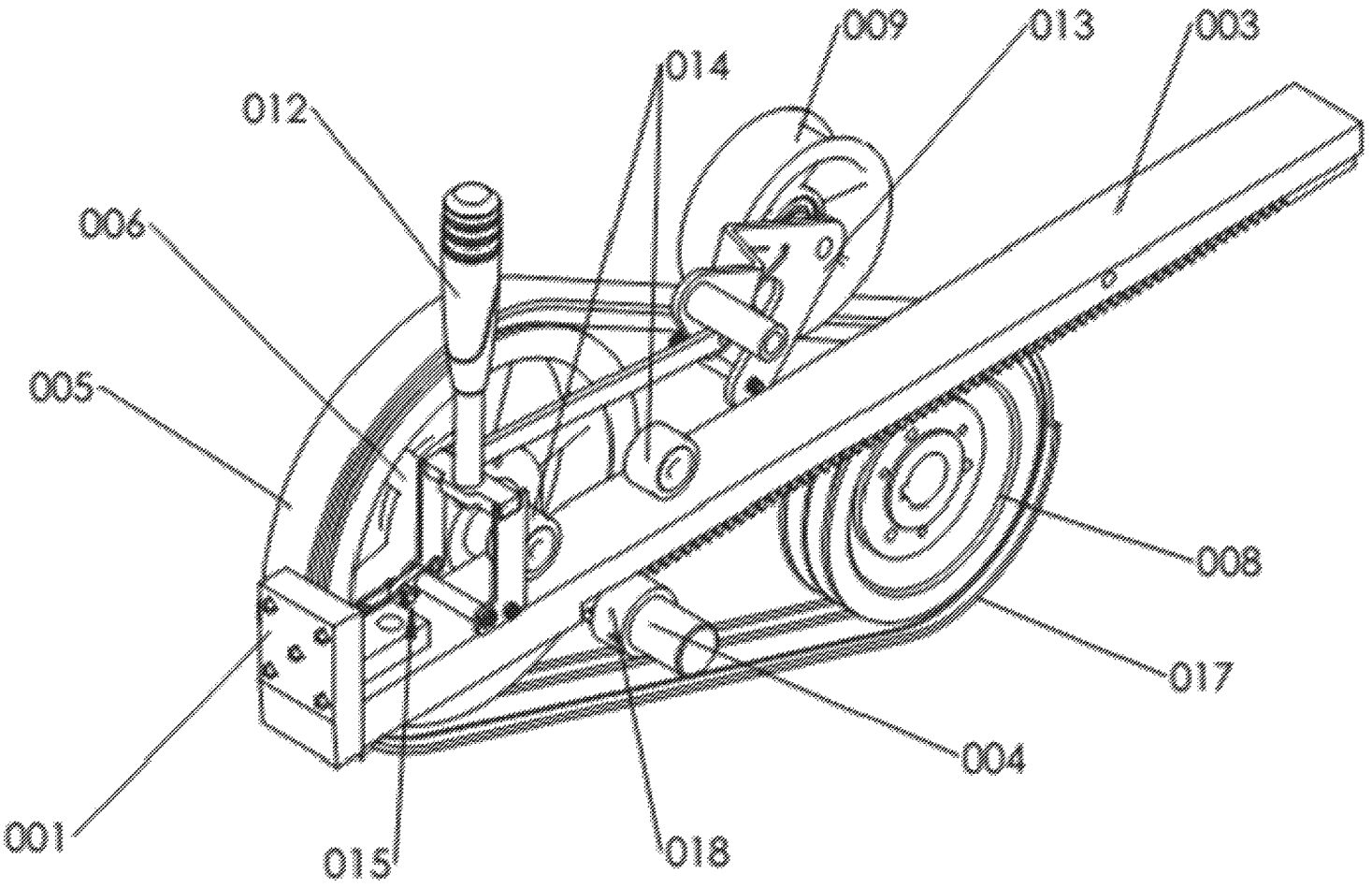
FIG. 3B illustrates a second side view of a belt drive system of a kinetic splitter and components thereof in a disengaged state, in accordance with various embodiments.
Figure 4A:
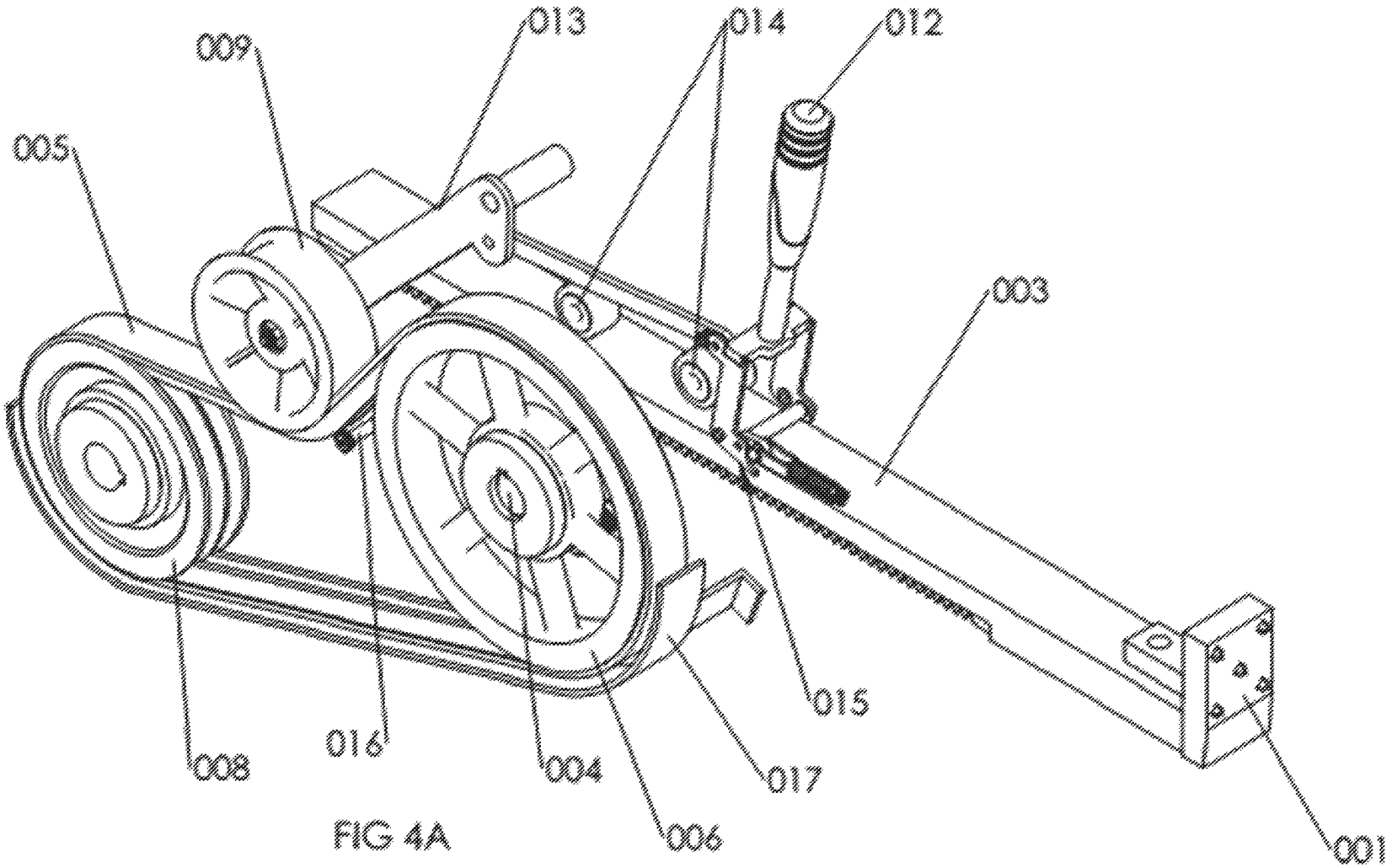
FIG. 4A illustrates a first side view of a belt drive system of a kinetic splitter and components thereof in an engaged state, in accordance with various embodiments.
Figure 4B:
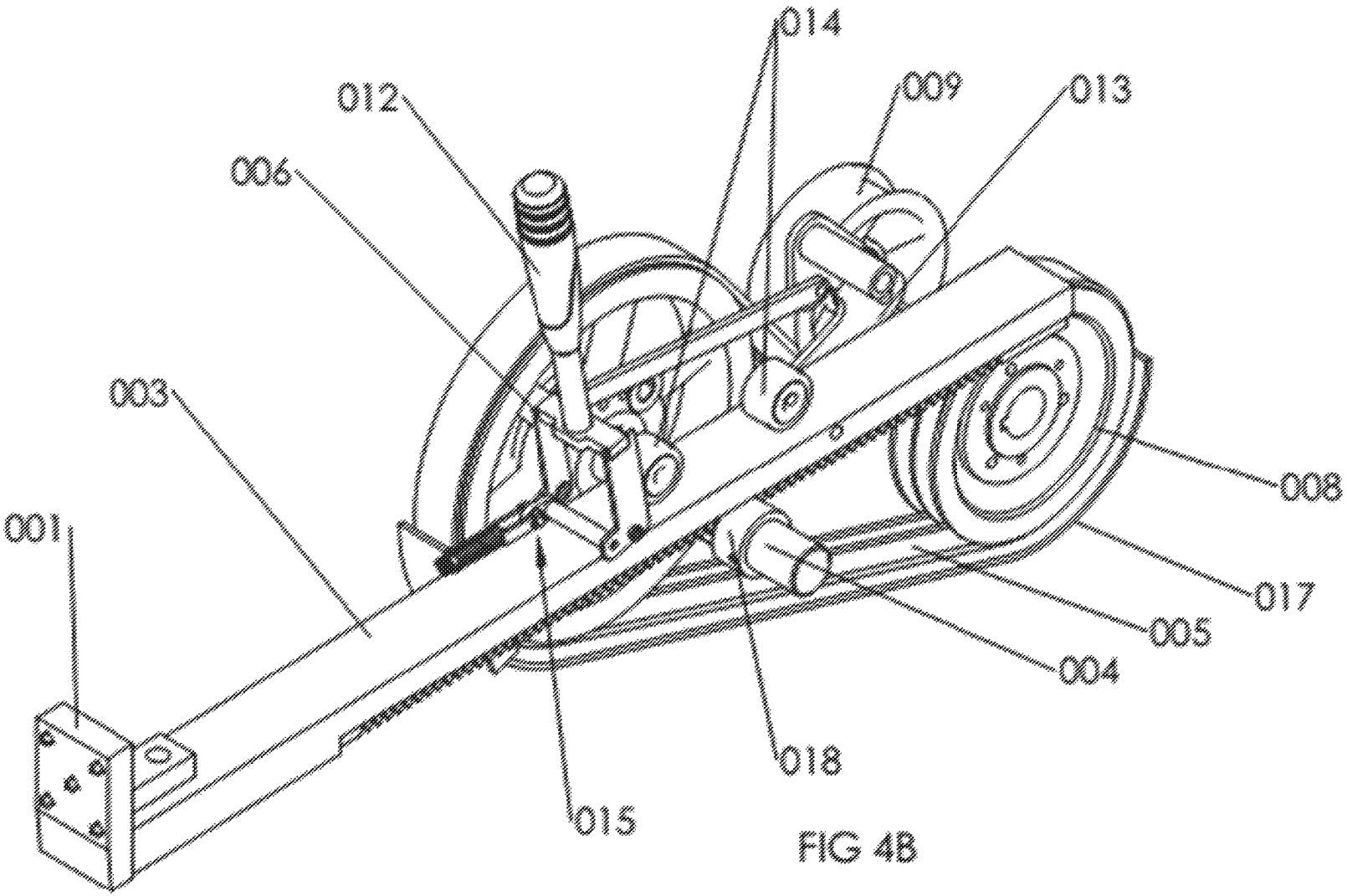
FIG. 4B illustrates a second side view of a belt drive system of a kinetic splitter and components thereof in an engaged state, in accordance with various embodiments.
Figure 5A:
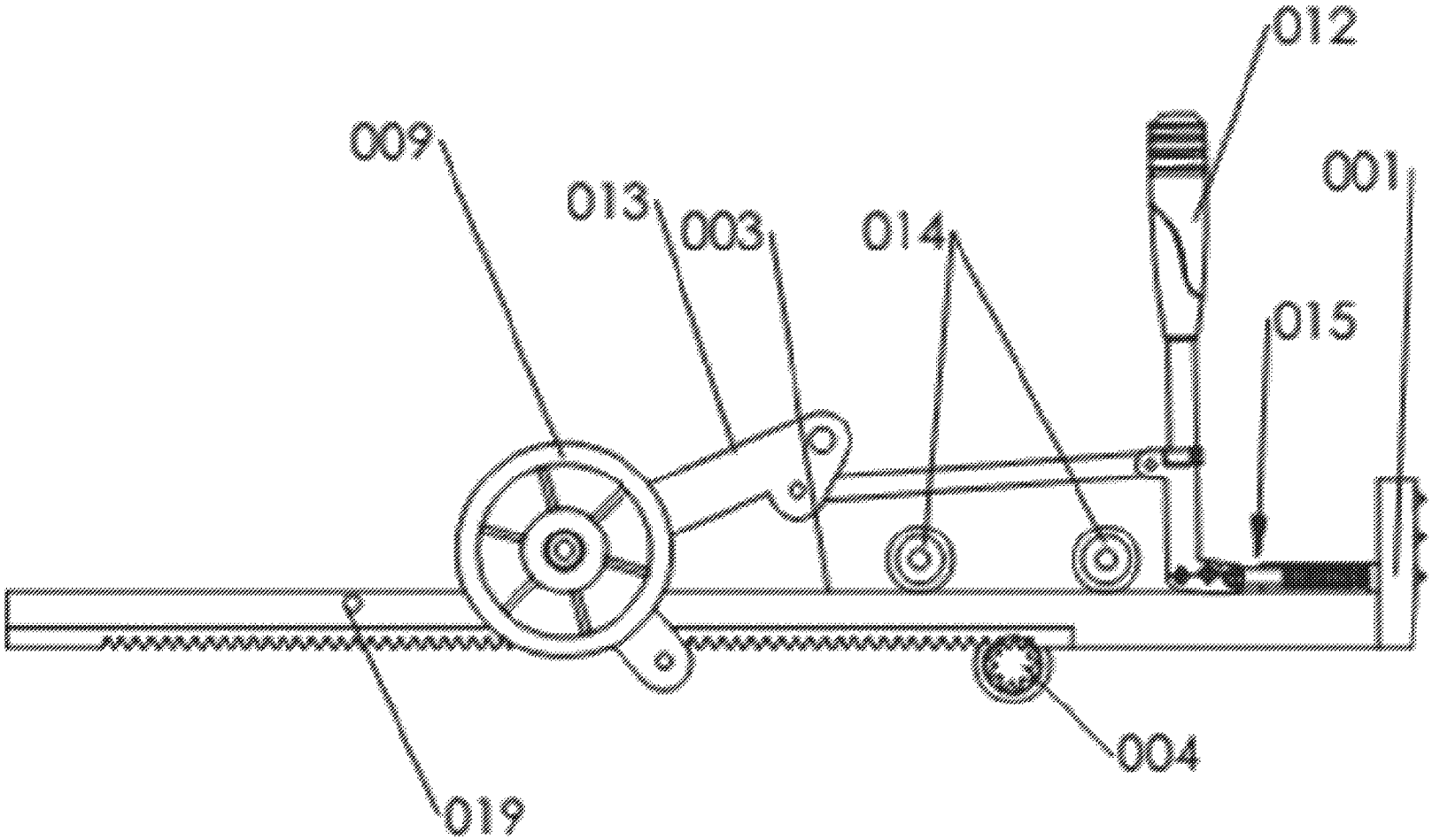
FIG. 5A illustrates a first simplified side view of a kinetic splitter and components thereof, in accordance with various embodiments.
Figure 5B:
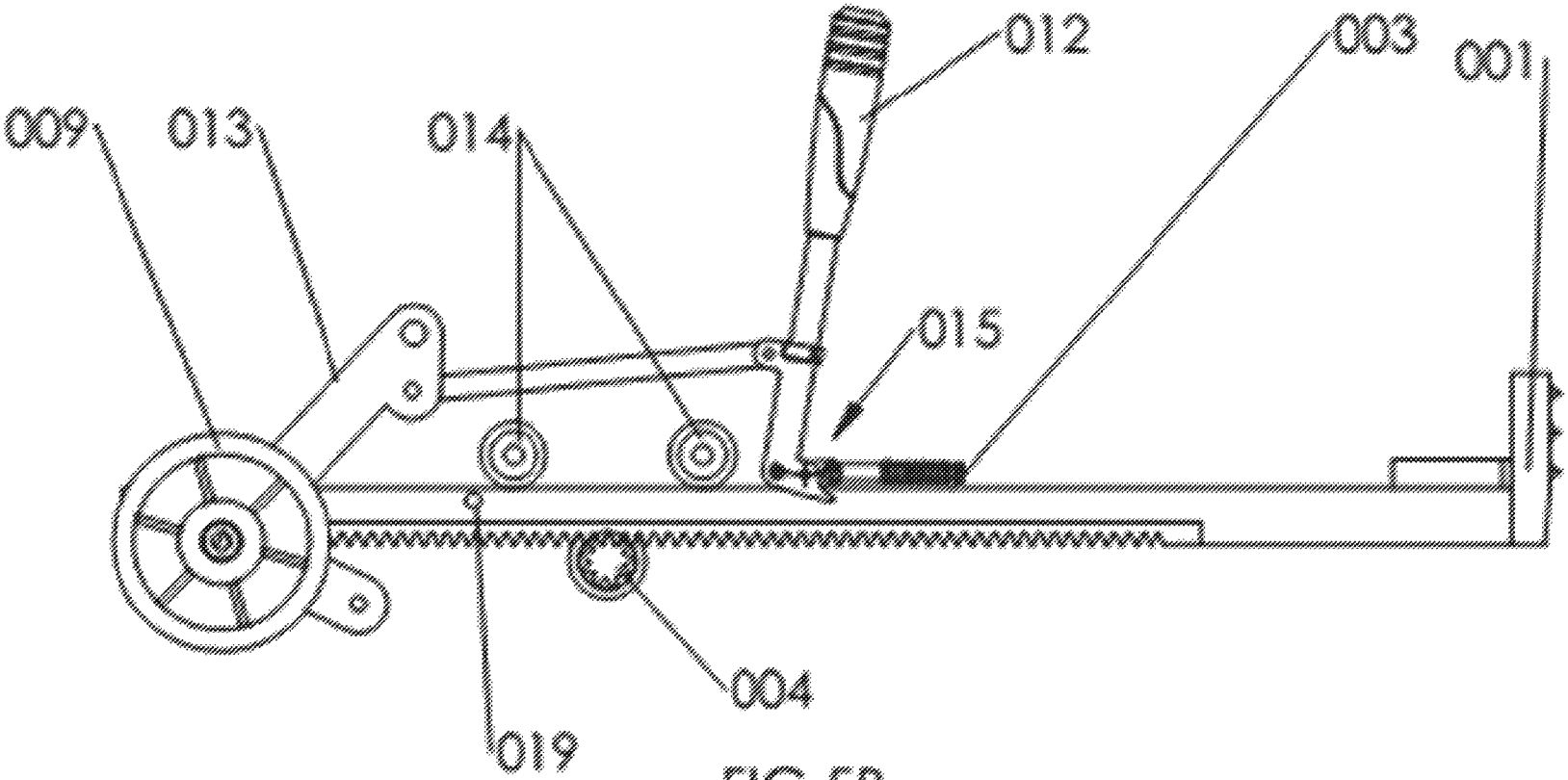
FIG. 5B illustrates a second simplified side view of a kinetic splitter and components thereof, in accordance with various embodiments.
Figure 5C:
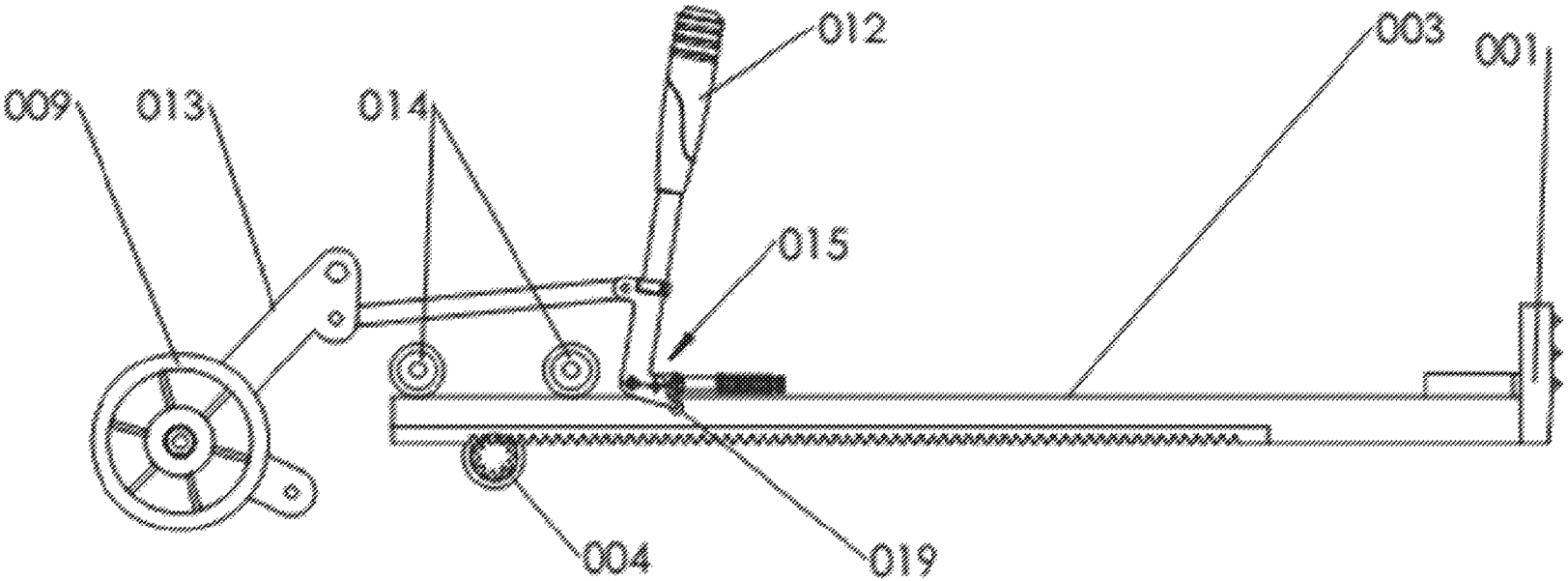
FIG. 5C illustrates a third simplified side view of a kinetic splitter and components thereof, in accordance with various embodiments.
Figure 6A:
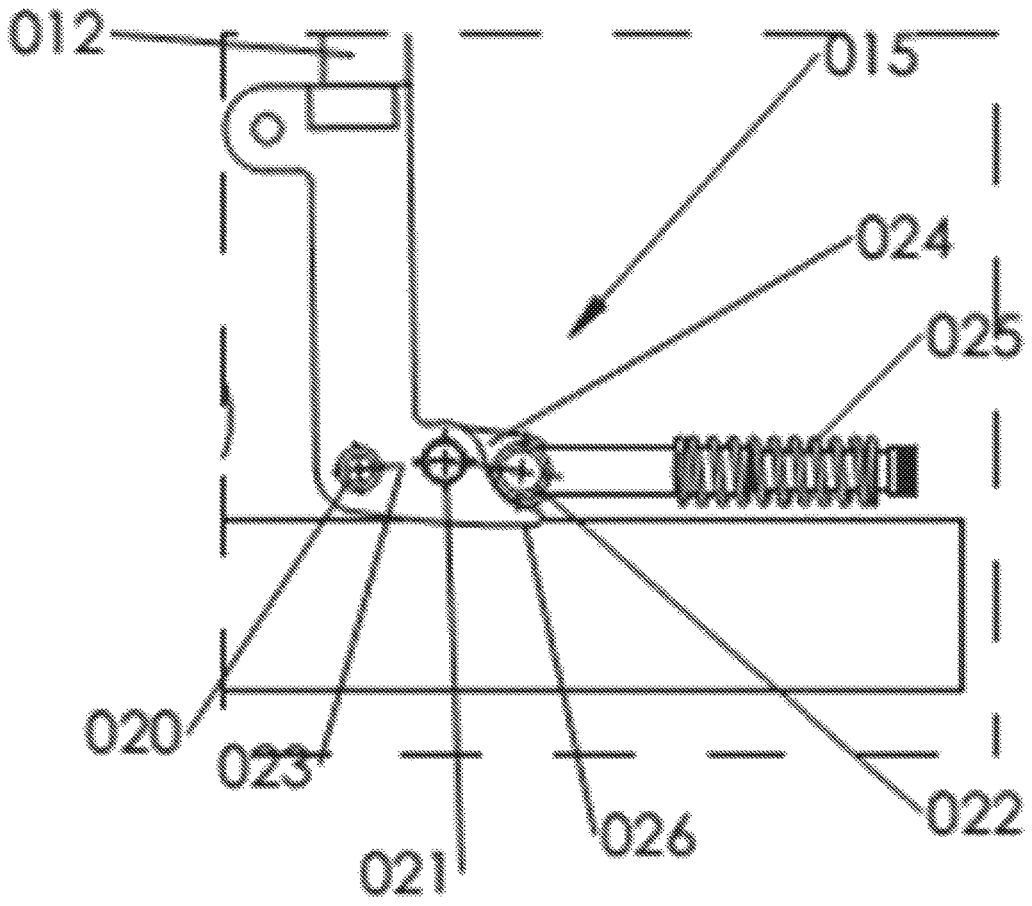
FIG. 6A illustrates a first simplified view of a linkage of a kinetic splitter and components thereof, in accordance with various embodiments.
Figure 6B:
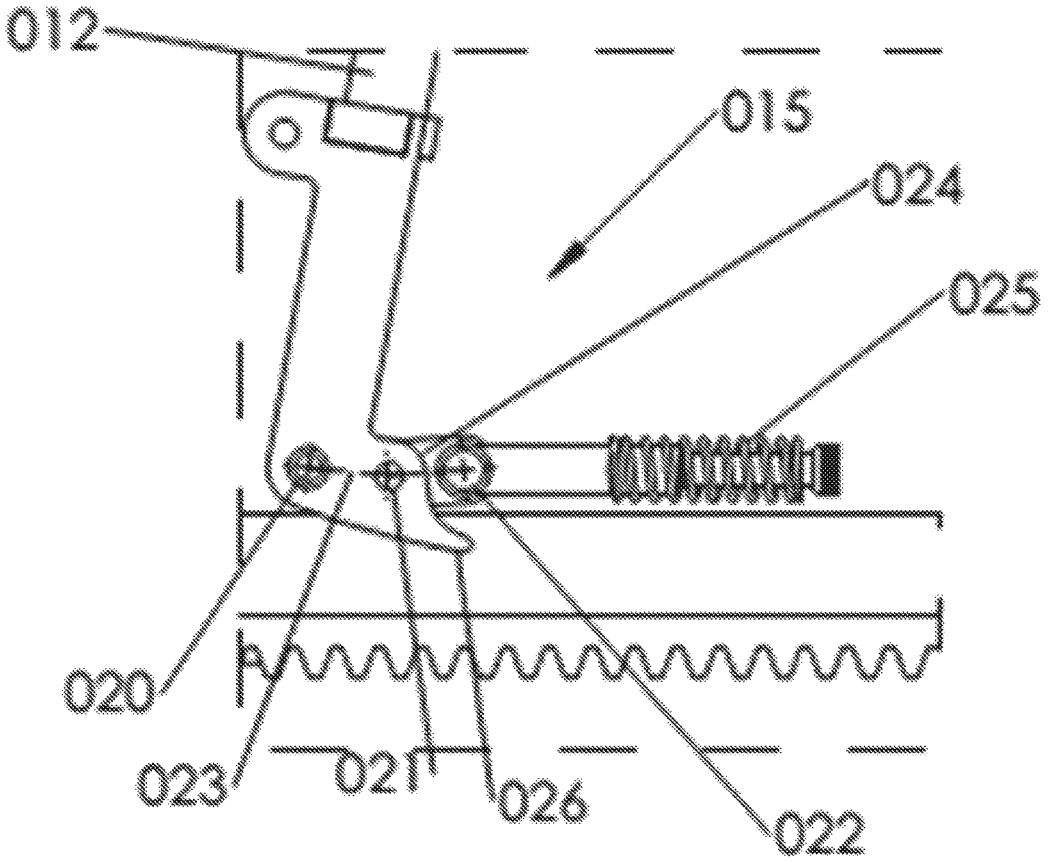
FIG. 6B illustrates a second simplified view of a linkage of a kinetic splitter and components thereof, in accordance with various embodiments.
Figure 6C:
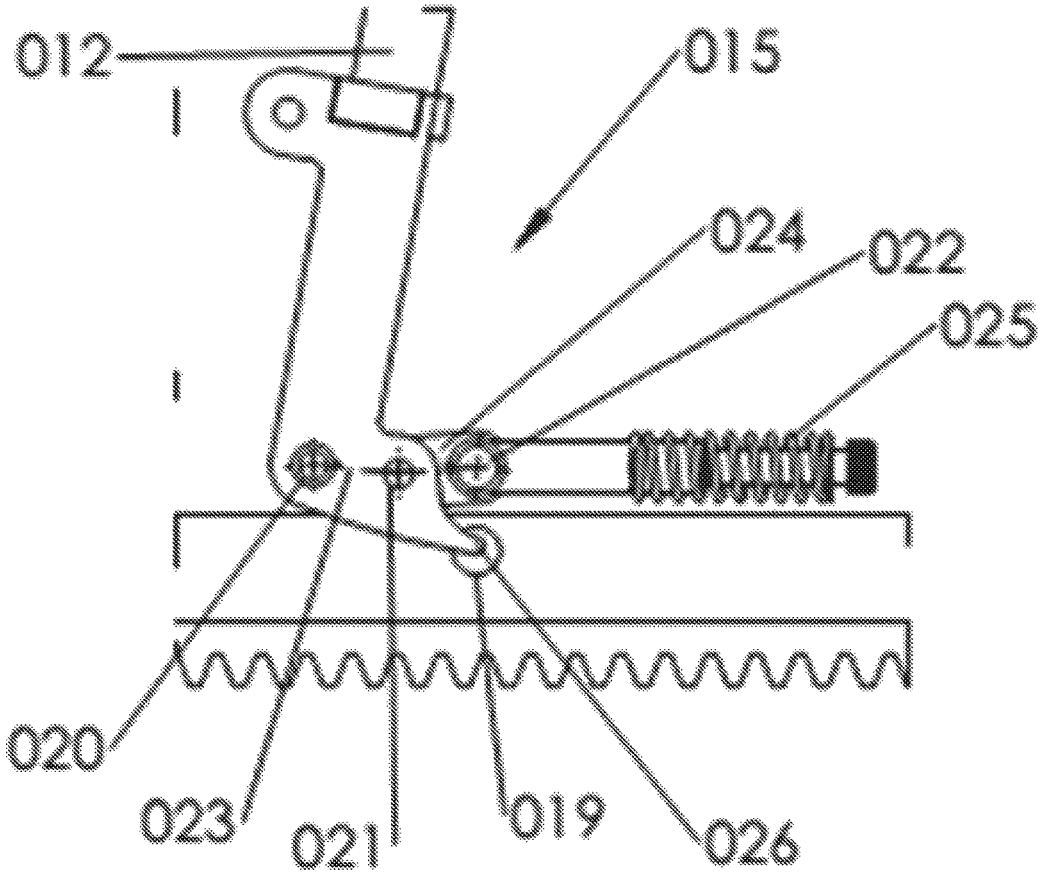
FIG. 6C illustrates a third simplified view of a linkage of a kinetic splitter and components thereof, in accordance with various embodiments.
Figure 7A:
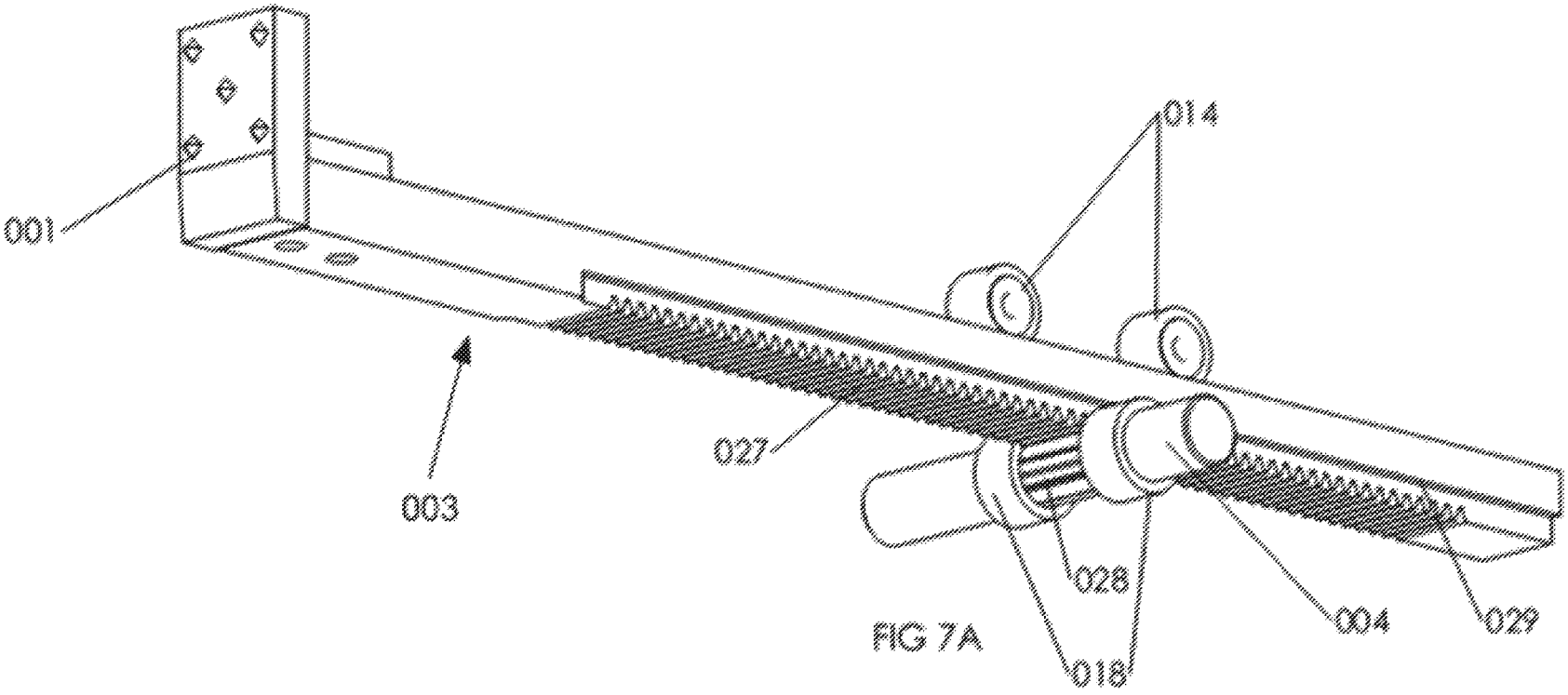
FIG. 7A illustrates a first simplified view of a rack and pinion of a kinetic splitter and components thereof, in accordance with various embodiments.
Figure 7B:
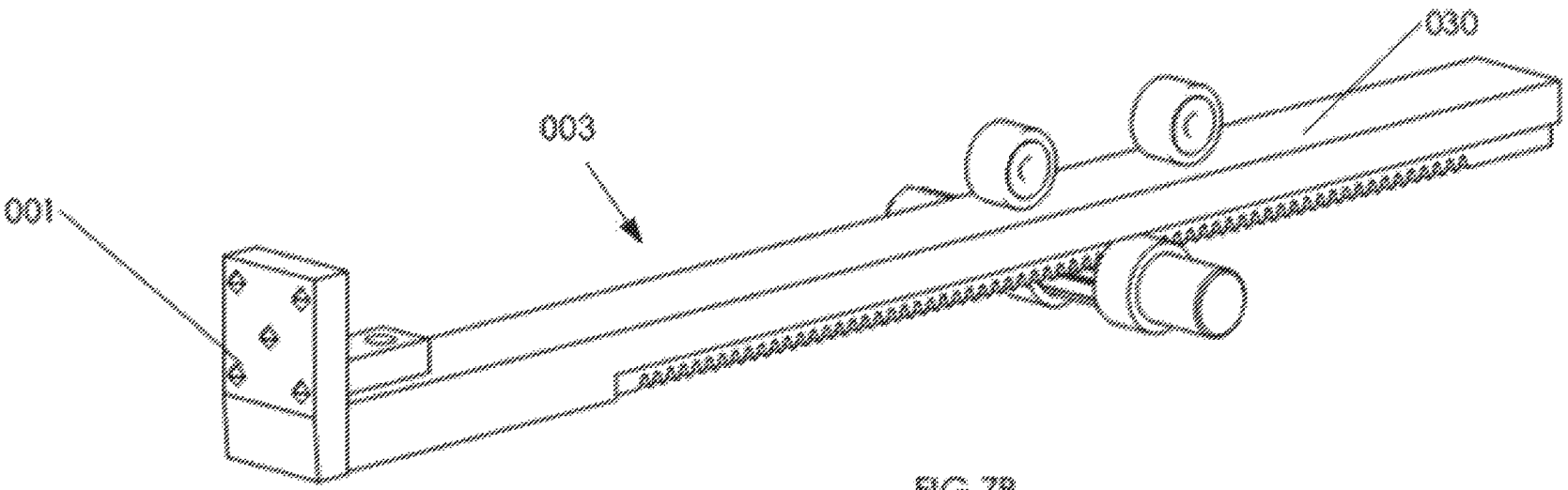
FIG. 7B illustrates a second simplified view of a rack and pinion of a kinetic splitter and components thereof, in accordance with various embodiments.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "NB" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB); that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

Embodiments herein provide a log splitting device wherein a ram (also referred to as a push plate) mechanism forces wood onto a wedge portion. In various embodiments a wedge may be forcibly moved into wood that is held in place by an anvil. In various embodiments the moving mechanism may be driven by a rack and pinion system.

Specifically, in some embodiments a kinetic splitter may have a belt drive system that may include a clutch system to link energy of a flywheel to a rack and pinion. The belt drive system may be designed to prevent damage to the rack and pinion by controlling the deceleration of the flywheel. The rate of deceleration may be proportional to the energy absorbed by the rack, pinion, pinion bearings, and/or the wood being split. If the flywheels were to stop immediately, one or more of the rack, pinion, and/or pinion bearings could be damaged. Using the disclosed belt drive system, the flywheel may be instead decelerated over a time span of between 0.3 seconds to 0.5 seconds (or a different time span in different embodiments), which may result in approximately 18,000 pounds of force being delivered to the kinetic splitter.

In embodiments, the disclosed kinetic splitter may specifically include an engagement lever system that may rely on tension via position rather than force. This engagement lever system may supply tension to belts of the kinetic splitter that may in turn drive a push plate or ram forward, and then automatically disengage from the system at the end of the stroke.

FIGS. 1-9B illustrate various views of a kinetic splitter and components thereof in accordance with various embodiments.

In various embodiments, the pinion 004 may be driven by a belt drive system. A driven sheave 006 is attached to the end of the pinion 004 such that rotation of the driven sheave 006 causes the pinion 004 to rotate.

In various embodiments a belt drive system may comprise a driven sheave 006, a drive sheave 008, an idler 009, and a belt 005. A belt 005 may have a cross-sectional shape that is rectangular, trapezoidal, triangular, round, or any other suitable shape. In embodiments, the drive sheave 008 may have a diameter of at least four inches. In some embodiments, the drive sheave 008 may have a diameter that is between approximately 25% and approximately 100% of the diameter of the driven sheave 006. The ratio between the drive sheave 008 and the driven sheave 006 may allow the flywheel 007 to rotate at a maximum kinetic energy while the pinion 004 rotates at a relatively slower speed. As a result, this configuration may optimize the process of splitting a log 031 in a controlled manner.

In various embodiments a belt system is held loosely around the driven sheave 006 and the drive sheave 008. A drive sheave 008 may be mounted to a rotating inertial mass, for example, a flywheel 007. Such a rotating inertial mass is caused to rotate by means of a motor/engine 010. The flywheel 007 may be caused to rotate by motor 010 by use of a belt system or by a toothed gear-drive system, or by direct connection between the flywheel 007 and the motor 010. The inertial mass is of sufficient size and weight, and may be rotating at a sufficient speed to provide enough rotating kinetic energy that a rack and pinion system could provide enough force to a log 031 that it would split against a wedge 002. In embodiments, the engine may be a gasoline combustion engine, a propane combustion engine, a diesel combustion engine, an electric powered motor, a hydraulic powered motor, a power takeoff drive system, or some other type of motor/engine 010.

In various embodiments, idler 009 is placed at the perimeter of the loop formed by a loose-fitting belt 005. The idler 009 may be pressed into the back side or outside perimeter of a loose-fitting belt 005 such that the perimeter of the belt 005 is pushed toward the centerline that exists between the centers of the driven sheave 006 and the drive sheave 008. A two-sheave belt system has a tension side and a slack side. The slack side of the belt 005 exists on the side where the belt 005 is moving away from the driven sheave 006, and toward the drive sheave 008. A belt 005 is primarily effective at transmitting force through tension on belt 005. It does not effectively transmit force through compression. For this reason, tension may be added to the belt drive system through an idler 009 by adding tension to the slack side of the belt 005 with very little force back against the idler 009. There may be much less force needed to maintain a belt tension when it is applied to the slack side of a drive system.

In various embodiments, an idler 009 is attached to an actuation linkage that allows an operator to control the position of the idler 009. The actuation linkage may be attached to an actuator 012, such as a handle or button, that an operator can control.

An actuation linkage may be used that will stay in an actuated state or latch after an initial actuation is performed. This latch system may utilize a two-bar over-center linkage 015. A first bar 023 is connected to an actuating handle, lever, or button and is attached to a rigid structure by a first pin 020 that allows the first bar 023 and an actuator 012 to rotate about a first pin 020. A second bar 024 exists that is connected on one end to the first bar 023 through a second pin 021, and on the other end is connected to a horizontally mounted compression spring 025 through a third pin 022. The first bar 023 and the second bar 024 may be connected, via the second pin 021, in such a way that an angle exists between the first bar 023 and the second bar 024. The compression spring 025 attached to the second bar 024 is applying pressure in a way that causes the third pin 022 to move closer to the first pin 020, and causes the second pin 021 to move away from a centerline that can be drawn between the first pin 020 and third pin 022. To utilize the latch system, rotation is applied to the first bar 023 through the handle that causes the second pin 021 to rotate to the point that it is close to the centerline between the first pin 020 and the third pin 022. Once the second pin 021 reaches a point where it has rotated beyond the point where it is aligned with the first pin 020 and third pin 022, the compression spring 025 continues to force past the aligned position. The actuator 012 remains in an actuated state until it is forced back in the opposite direction.

Various embodiments may attach the actuator 012 of an over-center linkage 015 to a pivoting arm 013 that causes the idler 009 to tighten the belt 005 when in an actuated state. The compression spring 025 used must apply sufficient force to hold the mass of the idler 009 away from the belt 005 in an actuated state, but apply enough force to the idler 009 during actuation to provide enough tension to the belt drive system to effectively split wood.

As described in greater detail below, various embodiments of the kinetic log splitter may include an actuator 112 that may actuate a disengaging linkage 131, which may in turn force a handle linkage system 135 into an over-center relationship with an idler mounting arm 113. In this configuration, the idler mounting arm 113 may therefore apply sufficient tension to the drive belt system to split wood.

Various embodiments utilize an over-center release mechanism to disengage the idler 009 at the end of travel. Various embodiments permit a part of the over-center latch 026 to rest along the side face of the rack 003. At the end of travel for the rack 003, a release pin 019, mounted in the side of the rack 003, pushes on the bottom of the rack linkage, disengaging the over-center linkage 015. In a different embodiment, the second pin 021 over the over-center linkage 015 rests along the top surface of the rack 003. A wedge 002 mounted to the top of the rack 003 forces the second pin 021 to move back to the unactuated state.

In various embodiments a retraction spring 011 is placed on the ram 001 and attached to the frame of the splitter. Once the idler 009 has been disengaged, the retraction spring 011 pulls the ram 001 and rack 003 back to the retracted state until the next actuation. It will be noted that although the ram 001 is depicted as an anvil, in other embodiments the ram 001 may be a wedge.

In various embodiments bumpers 032 are used at the end of travel to help stop the ram 001, rack 003, pinion 004, and driven sheave 006. Because all of these components have significant inertia, compression springs may be used for the bumpers 032. The springs may be used to store potential energy, and provide additional force to assist the ram 001 slowing then reversing.

In some embodiments, one or both of the retraction spring 011 and/or the bumpers 032 may be configured to allow splitting power to be maintained as long as possible while shortening the cycle time of the splitting process. Specifically, the rack 003, and specifically the ram 001, may be required to decelerate (e.g., disconnect power from the flywheel), stop, and return to a "home" position. In some embodiments, the rack 003, and specifically the ram 001, may be required to decelerate and/or stop before the ram 001 physically hits the wedge 002. In some embodiments, the rack 003, and specifically the ram 001, may be required to decelerate and/or stop when the ram 001 is within approximately an inch of the wedge. In some embodiments, the rack 003, and specifically the ram 001, may be required to decelerate and/or stop when the ram 001 is within between one and a half inches and half an inch from the ram. The use of the bumpers 032 and/or the retraction spring 011 may allow the rack 003 and ram 001 to decelerate in as short a space as possible. The retraction spring 011 and/or the bumpers 032 may also aid the return of the rack 003 and the ram 001 to a "home" position after a full stroke, which may reduce the time of a splitting cycle.

An example process of decelerating, stopping, and reversing the rack 003 and/or ram 001 may be as is described in the following enumerated elements. Specifically, the bumpers 032 and/or retraction spring 011 may be configured to absorb the energy of the ram 001, compress the bumpers 032 and/or retraction spring 011, and allow the ram 001 to get within approximately 0.25 inches to one and a half inches of the wedge 002 (for a full split) without a sudden stop to the ram 001 and/or rack 003.

1) The ram 001 may contact the bumpers 032 and begin initial compression of the bumpers 032. In other embodiments the retraction spring 011 may start to stretch which may generate a force similar to the compression of the bumpers 032. During this time, the kinetic splitter may be actively splitting wood, and the ram 001 may be approximately one and a half inches from the wedge 002.

2) The belt drive system may disengage the flywheel 007 from the ram 001, rack 003, pinion 004, and driven sheave 006. During this time, the ram 001 may be approximately one inch from the wedge 002.

3) The bumpers 032 and/or retraction spring 011 may absorb the inertia of the ram 001, rack 003, pinion 004, and/or driven sheave 006 as the system comes to a stop. At this time, the ram 001 may be approximately 0.4 inches from the wedge 002.

4) The bumpers 032 and/or retraction spring 011 may release their stored energy to send the ram 001, rack 003, pinion 004, and/or driven sheave 006 back to the starting "home" position.

In some embodiments the kinetic splitter may further include a dampener system (not shown) mounted at the home position of the ram 001. This dampener system may be similar to or the same as elements of the bumpers 032 and/or retraction spring 011. The dampener system may be configured to absorb the inertia of the ram 001, rack 003, pinion 004, and/or driven sheave 006 while the ram 001 is returning to its home position. The ram 001 may be returning to its home position at a speed of approximately 30 inches per second, though in other embodiments the ram may be moving at a different rate of speed.

In various embodiments the rack 003 takes the form of a rectangular beam with teeth 027 that are centered on a side. The teeth do not span the full width of the rectangular beam, leaving two coplanar flanges on either side of the teeth 027. Rack teeth 027 are configured to engage with pinion teeth 028.

In various embodiments the rack 003 is supported on both the top and bottom. The bearings 018 on the bottom are concentric with the pinion shaft and the outer circumference of these bearings rides on the flanges on either side of the rack teeth 027. Two bearings 014 are centered on the side 030 of the rack 003 that is opposite the side 029 that has teeth 027. The bearings 014 are spaced so that one bearing lies in front of the pinion 004 closer to the wedge 002 and the other lies behind the pinion 004 closer to the rear of the splitter. The two bearings that are collinear with the pinion are used to set the proper engagement distance. The two bearings on the opposite side are used to resist the tendency of the rack 003 to disengage when a force is applied horizontally on the end of the rack 003, perpendicular to the center axis of the pinion 004.

In various embodiments a belt support 017 may be used to support the tension side of the belt system when it is in an unactuated, loose-fitting state. The support may be a piece of material that is mounted a small distance below and parallel to the tension side of the belt 005 when it is under tension. The guard may also follow the contour of the driven sheave 006 and drive sheave 008 to no more than a point that the support would be horizontal from the center point of each respective sheave. These support pieces may control ballooning of the belt 005 when it is not under tension, allowing it to be held up out of the grooves of the driven sheave 006 or the drive sheave 008. Supporting a belt 005 in such a manner allows the driven sheave 006 and the belt 005 to remain stationary in the unactuated state while the drive sheave 008 continues to rotate. It also allows the driven sheave 006 to be able to rotate backward while the rack 003 and ram 001 are retracting.

In various embodiments a pin 016 is placed on the arm 013 used to actuate the idler 009 that is positioned just below the belt 005. When the belt 005 is disengaged, this pin 016 pulls up on the slack side of the belt 005 to disengage it from the grooves of the sheave. Under heavy loads, the belts may become lodged in the grooves of the sheave.

Figure 8:
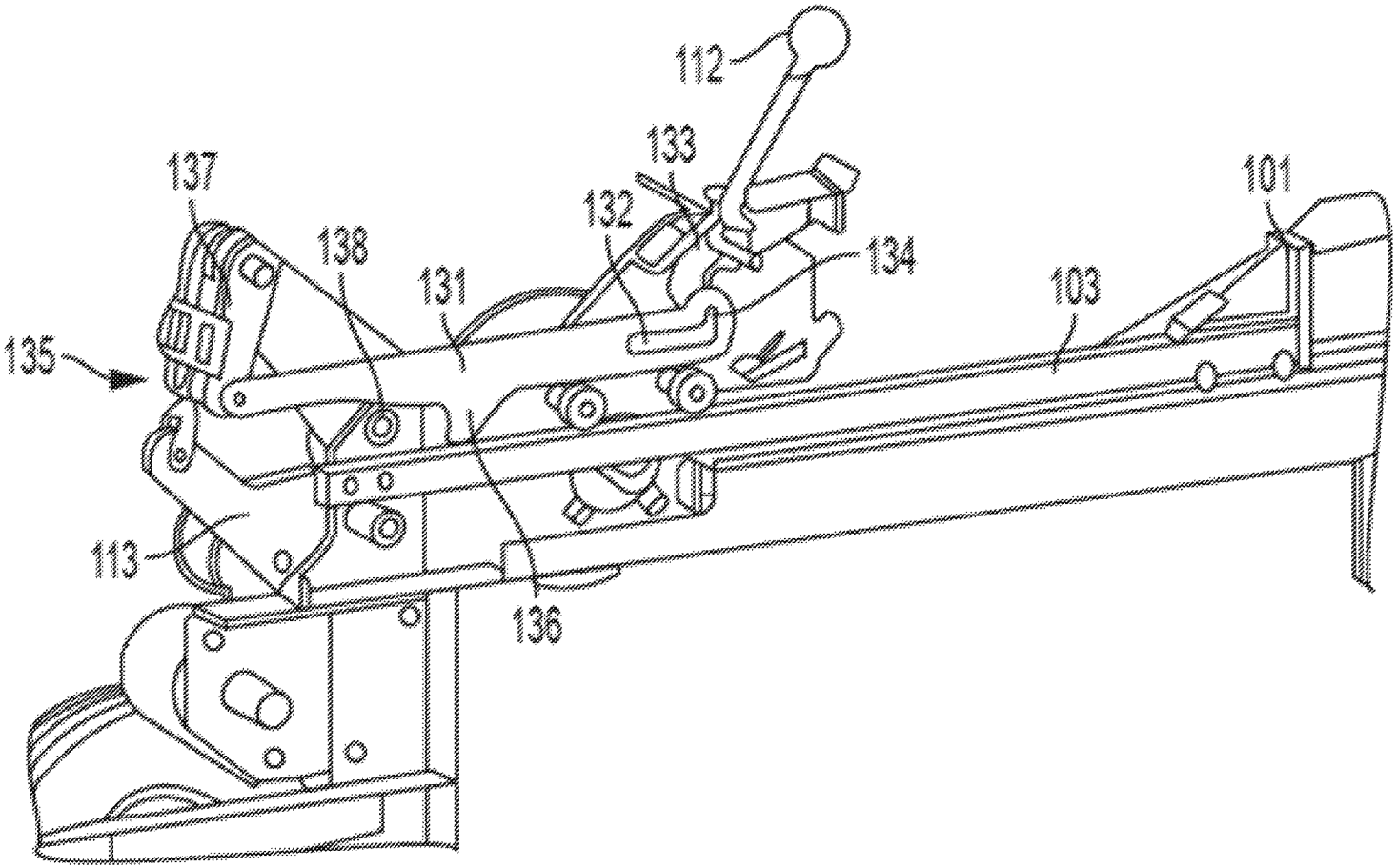
FIG. 8 illustrates a view of a handle linkage mechanism of a kinetic splitter and components thereof, in accordance with various embodiments.

FIG. 8 depicts an alternative embodiment of a kinetic splitter that may include a handle linkage system 135. The embodiment of the kinetic splitter depicted in FIG. 8 may have elements that are similar to similarly numbered elements of FIGS. 1-7B. Specifically, the kinetic splitter depicted in FIG. 8 may include a rack 103, a ram 101, an actuator 112, and an idler mounting arm 113 that may be respectively similar to the rack 003, ram 001, actuator 012, and pivoting arm 013 described above. The kinetic splitter depicted in FIG. 8 may include further elements such as a pinion, etc. that are not specifically enumerated in FIG. 8 for the sake of clarity.

The handle linkage system 135 may be configured to allow an operator to hold the actuator 112 in a splitting position at the end of the stroke cycle without the force of the rack 103 abruptly forcing the actuator 112 to the disengaged position. The operator may continue to hold the actuator 112 in the engaged position while the machine resets and prepares for a second splitting action, without damage to the operator and/or the machine.

Specifically, in the embodiment depicted in FIG. 8, the actuator 112 may be coupled with an arm 133 that includes a pin 134 on the end. The pin 134 may be configured to go into a cutout portion 132 of a disengaging linkage 131. At the end of the stroke, a cam 138 mounted to the end of rack 003 may follow the contour 135 on the bottom of the disengaging linkage 131, which may lift the cutout portion 132 such that the pin 134 may be released from the notch in the cutout portion 132. This action may release the actuator 112 from an active role in the handle linkage system 135. Further, the counter 136 of a disengaging linkage 131 may be made such that it changes from a primarily horizontal surface to a primarily vertical surface, which may allow the cam 138 to push the disengaging linkage 131 forward, thus pulling the pivot linkage 137 and pivoting arm 113 out of their over-center alignment, and allow the belt idlers to move, thereby releasing tension in the belt system. This release of tension in the belt system may disengage power to the rack 103.

Figure 9A:
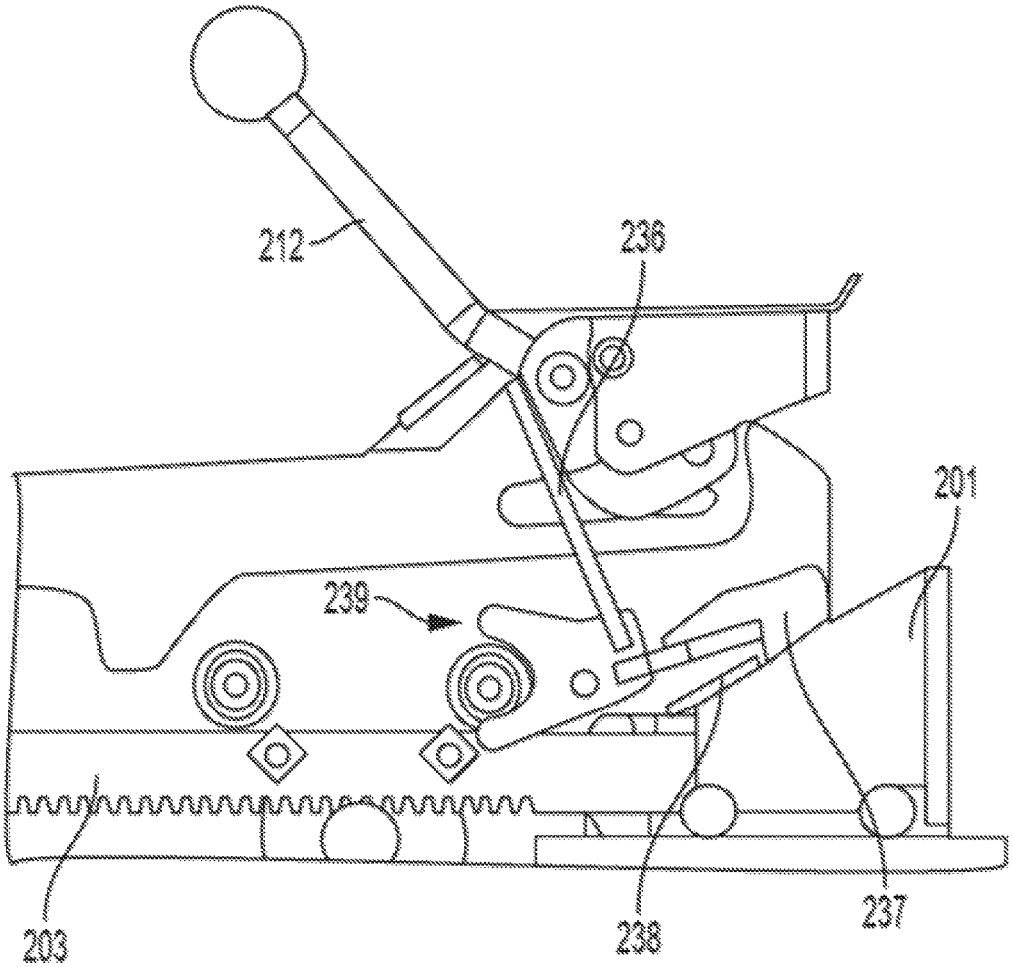
FIG. 9A illustrates a first view of a push plate lock of a kinetic splitter and components thereof, in accordance with various embodiments.
Figure 9B:
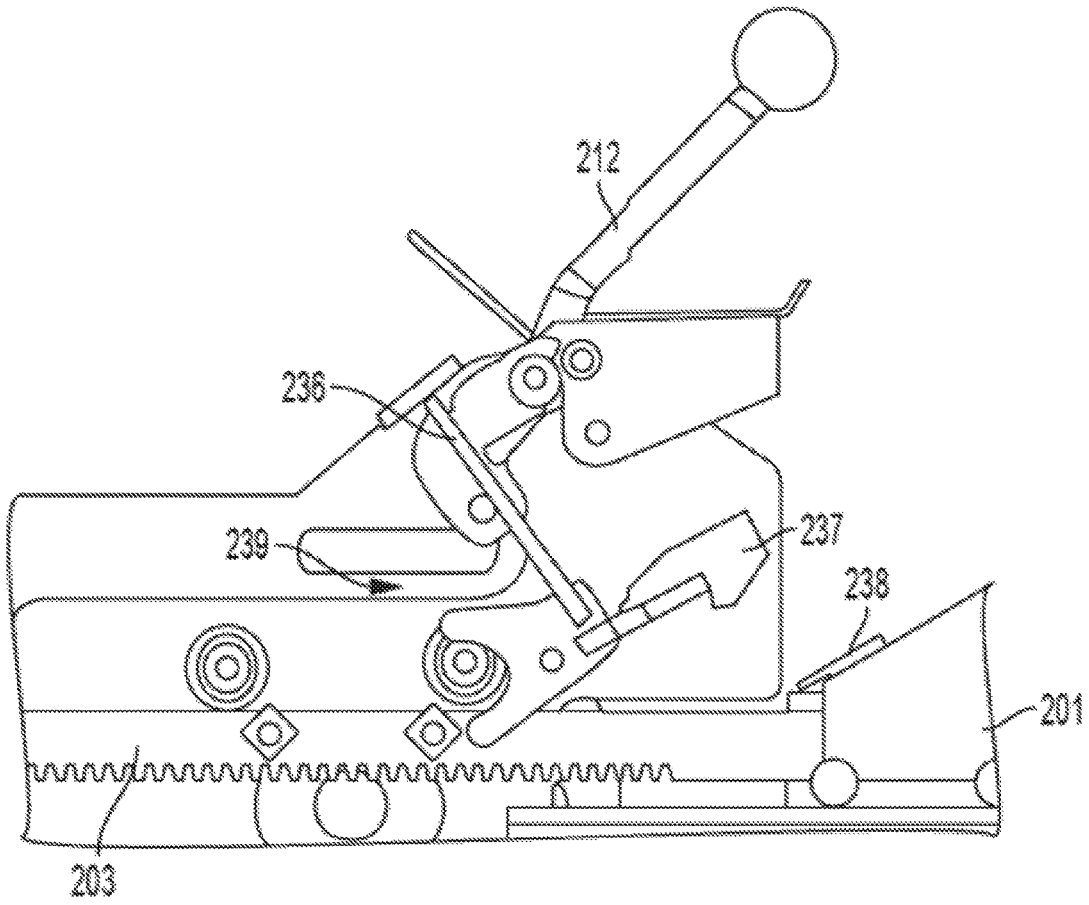
FIG. 9B illustrates a second view of a push plate lock of a kinetic splitter and components thereof, in accordance with various embodiments.

FIGS. 9A and 9B depict an alternative embodiment of a kinetic splitter that may include a ram lock 239 that may prevent the ram from moving unless the actuator is moved forward by the user. The embodiment of the kinetic splitter depicted in FIG. 9 may have elements that are similar to similarly numbered elements of FIGS. 1-7B. Specifically, the kinetic splitter depicted in FIG. 9 may include a ram 201, a rack 203, and an actuator 212 that may be respectively similar to the ram 001, rack 003, and actuator 012 described above. The kinetic splitter depicted in FIG. 9 may include further elements such as a pinion, etc. that are not specifically enumerated in FIG. 9 for the sake of clarity.

In some embodiments, the ram 201 may include a protrusion 238. The ram lock 239 may include a locking mechanism 237 configured to mate with the protrusion 238. The ram lock 239 may further include an arm 236 that is in physical connection with the actuator 212. When the actuator 212 is moved, the movement of the actuator 212 may cause the arm 236 to be rotationally or laterally displaced, which in turn may cause the ram lock 239 to rotate. When the ram lock 239 rotates, the locking mechanism 237 may disengage with the protrusion 238 as shown in FIG. 9B.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A kinetic log splitter comprising:
- a geared rack;
- a ram coupled with the geared rack;
- a pinion coupled with the geared rack, the pinion to cause the ram and geared rack to translate linearly based on rotation of the pinion;
- a drive sheave coupled with the pinion to rotate the pinion;
- a driven sheave coupled with the pinion;
- a linkage that encircles the drive sheave on a first end of the linkage and the driven sheave on a second end of the linkage;
- a flywheel coupled with the drive sheave such that the drive sheave is to receive energy from the flywheel; and
- an engine coupled with the flywheel.

2. The kinetic log splitter of claim 1, wherein the linkage is a belt.

3. The kinetic log splitter of claim 1, further comprising an idler pulley to selectively add tension to the linkage, wherein the tension is to cause the driven sheave to rotate at a proportional speed to the drive sheave.

4. The kinetic log splitter of claim 3, further comprising an actuation device coupled with the idler pulley.

5. The kinetic log splitter of claim 4, further comprising a latch system to keep the actuation device in an actuated state.

6. The kinetic log splitter of claim 3, further comprising a mechanism coupled with a pivoting support of the idler pulley, wherein the mechanism is to forcibly disengage the linkage from the sheaves while the linkage is in an unactuated state.

7. The kinetic log splitter of claim 1, wherein the rack includes teeth, and further comprising bearings on either side of the rack, wherein the bearings support the rack and the bearings have a center axis that is coaxial with a centerline of the pinion.

8. A kinetic log splitter comprising:
- a geared rack;
- a ram coupled with the geared rack;
- a pinion coupled with the geared rack and to cause the ram and geared rack to translate linearly based on rotation of the pinion;
- a flywheel coupled with the pinion to rotate the pinion;
- an engine coupled with the flywheel;
- a first bar rigidly coupled at a first end of the first bar to an actuation handle, the first bar further rotationally coupled with a first pin;
- a second pin coupled with a second end of the first bar;
- a second bar coupled with the second pin at a first end of the second bar, the second bar further coupled with a compression pin through a third pin at a second end of the second bar; and a compression spring to push the first and third pins toward each other, while causing the second pin to move in a direction perpendicular to a line drawn between the first and third pins;

wherein the first bar, upon actuation of the actuation handle, is to rotate such that the second pin comes into alignment with the first and third pins until it moves past alignment, and holds the actuation handle in an actuated position.

9. The kinetic log splitter of claim 8, further comprising a handle linkage system, wherein at an end of travel the rack is to cause the handle linkage system to move to an unactuated position.

10. The kinetic log splitter of claim 9, wherein at an end of travel the actuation handle is decoupled from the handle linkage system.

11. The kinetic log splitter of claim 1, wherein the ram is a wedge.

12. The kinetic log splitter of claim 1, wherein the engine is a gasoline combustion engine, a propane combustion engine, a diesel combustion engine, an electric powered motor, a hydraulic powered motor, or a power takeoff drive system.

13. A kinetic log splitter comprising:

a geared rack;

a ram coupled with the geared rack;

a pinion permanently coupled with the geared rack, the pinion to cause the ram and geared rack to translate linearly based on rotation of the pinion;

a flywheel coupled with a drive sheave such that the drive sheave is to receive energy from the flywheel;

the drive sheave coupled with the pinion via a clutch and a linkage to rotate the pinion;

the linkage encircles the drive sheave on a first end of the linkage and the driven sheave on a second end of the linkage; and a power system coupled with the flywheel.

14. The kinetic log splitter of claim 13, wherein when the force required to split a log exceeds a force of the kinetic log splitter, the clutch prevents damage to the components of the log splitter.

15. The kinetic log splitter of claim 13, wherein tension of the linkage controls actuation, splitting force, and ability to retract the ram and geared rack.

16. The kinetic log splitter of claim 13, wherein the clutch includes a friction plate or ratcheting clutch system.

17. The kinetic log splitter of claim 13, further comprising a system used to actuate splitting motion of the kinetic log splitter, wherein the system is decoupled from a force of the rack at an end of a splitting stroke.

18. The kinetic log splitter of claim 13, further comprising a spring system, wherein the rack and ram energize the spring system at an end of a splitting stroke, wherein the spring system absorbs inertia of the pinion, rack, and ram, and wherein the spring system uses the absorbed energy to return the pinion, rack, and ram to a start position for subsequent log splits.

19. The kinetic log splitter of claim 18, wherein the spring system includes one or more compression springs and one or more extension springs.

20. The kinetic log splitter of claim 13, wherein the linkage is a belt.

21. A kinetic log splitter comprising:

a geared rack;

a ram coupled with the geared rack;

a pinion permanently coupled with the geared rack, the pinion to cause the ram and geared rack to translate linearly based on rotation of the pinion;

a flywheel coupled with a drive sheave such that the drive sheave is to receive energy from the flywheel, the drive sheave further coupled with the pinion via a clutch to rotate the pinion, wherein the clutch includes a friction plate or ratcheting clutch system;

a linkage that encircles the drive sheave on a first end of the linkage and the driven sheave on a second end of the linkage; and a power system coupled with the flywheel.

* * * * *